United States Patent [19]

Rubin et al.

[11] Patent Number: 4,592,382

[45] Date of Patent: Jun. 3, 1986

[54] ANTI-SIPHON NOZZLE

[75] Inventors: Sol R. Rubin, Beverly Hills; Joseph D. Robinson, Gardena, both of Calif.

[73] Assignee: Aqua-Giene, Inc., Los Angeles, Calif.

[21] Appl. No.: 644,787

[22] Filed: Aug. 27, 1984

[51] Int. Cl.[4] ..... F16K 24/00

[52] U.S. Cl. ..... 137/218; 137/102

[58] Field of Search ..... 4/447, 448; 137/102, 137/112, 217, 218

[56] References Cited

U.S. PATENT DOCUMENTS

| | | | |
|---|---|---|---|
| 2,209,189 | 7/1940 | Callejo | 137/218 |
| 2,594,999 | 4/1952 | Robinson . | |
| 2,604,113 | 7/1952 | Barsano | 137/218 |
| 2,627,278 | 2/1953 | Somers . | |
| 2,814,304 | 11/1957 | Sloan | 137/218 |
| 2,850,034 | 9/1958 | Svabek et al. | 137/218 |
| 3,076,470 | 2/1963 | Langdon | 137/218 |
| 3,338,257 | 8/1967 | Ferguson | 137/112 |
| 3,470,898 | 10/1969 | Langdon . | |
| 3,947,899 | 4/1976 | Robinson et al. | 4/447 |
| 4,064,896 | 12/1977 | Trenary . | |

FOREIGN PATENT DOCUMENTS

| | | | |
|---|---|---|---|
| 2062116 | 7/1978 | Fed. Rep. of Germany | 137/102 |

*Primary Examiner*—Gerald A. Michalsky

*Attorney, Agent, or Firm*—Henry M. Bissell

[57] ABSTRACT

A miniature anti-siphon valve is disclosed which is of inexpensive manufacture, requiring only three parts which may be molded rather than machined. The valve will close to prevent reverse fluid flow when either pressure in the supply line drops below ambient air pressure or fluid flow into the valve outlet occurs. The valve operates regardless of its physical orientation, and in one embodiment may include a nozzle for use with a bidet.

16 Claims, 5 Drawing Figures

ANTI-SIPHON NOZZLE

BACKGROUND OF THE INVENTION

1. Field of the Invention

The present invention relates generally to an improved anti-siphon valve and, more particularly, to a small and inexpensive valve with a positive valve action initiated by a pressure drop in a water supply line, the valving action occurring independently of the physical location or orientation of the valve.

2. Description of the Prior Art

Anti-siphon valves are inserted into a water supply line between a water source and the end of the water supply line to prevent the backflow of possibly contaminated water from the end of the supply line into the supply line on the source side of the anti-siphon valve. The problem arises when a drop in pressure in the line on the supply side of the anti-siphon valve creates a partial vacuum in the supply line tending to draw water backwards into the supply line. In many municipalities such anti-siphon valves are required by local codes.

A closely related valve is the vacuum breaker, which also prevents an undesired reverse flow of water into the outlet end of the supply line. The difference between anti-siphon valves and vacuum breakers is that anti-siphon valves typically include an air vent to allow the anti-siphon valve to close whenever pressure in the supply line drops below ambient air pressure. Vacuum breakers, on the other hand, are generally operated by fluid flow backwards through the valve, the backwards flow path tending to force a valve element against a valve seat to block such reverse fluid flow.

Anti-siphon and vacuum breaker valves typically use one of three valving mechanisms to block reverse fluid flow through the valve. These three mechanisms are a cylindrical valve element, a flap-type valve element, and a spherical valve element. Examples of such devices and the drawbacks of each such device are illustrated below.

The spherical type valve element is illustrated in U.S. Pat. No. 4,064,896, to Trenary, in which a vacuum breaker with a ball-shaped valve element operated solely by fluid flow through the valve as illustrated. The Trenary device includes a plurality of air vents in the valve housing, together with a floating flat annular washer to close the air vents when the valve element, a floating ball, is open. The structure and operation of the Trenary vacuum breaker are substantially different from those of the present invention.

The second type of valve is the flap type, which is illustrated in U.S. Pat. No. 3,470,898, to Langdon, and by U.S. Pat. No. 2,594,999, to Robinson. Both of these patents have a relatively flat, circular valve element which moves forward and backward relative to a valve seat depending on fluid flow through the valve. The Langdon device requires a great deal of precision in the manufacture of the valve to assure a complete seal against reverse flow through the valve. It may be immediately appreciated that such high degree of precision makes the Langdon device relatively costly to manufacture, which disadvantage is not aided by the fact that the Langdon device includes a relatively high number of parts having numerous machined surfaces. In addition, the Langdon device is not easily adaptable to being manufactured in a relatively small package due to the machined surfaces and the high degree of precision in manufacturing the device.

The Robinson device also has a relatively large number of parts and numerous machined surfaces, which make the device relatively complex and expensive to manufacture. In addition, while the Robinson device does have an air vent, it must be utilized in a normalized position to allow the flap valve mechanism to function normally. Failure to properly orient the device will allow completely unrestricted reverse flow through the device, thus restricting the usefulness of the Robinson device to an application in which the relatively large valve may be installed in a proper orientation.

The third type of anti-siphon valve utilizing a piston valve mechanism is illustrated by U.S. Pat. No. 2,627,278, to Somers. Like the previous devices, the Somers valve requires a number of machined surfaces, and contains not less than six parts. In addition, the Somers device must also be properly oriented to insure operation of the device to prevent reverse fluid flow through the valve. While the Somers device is capable of being manufactured in a moderately small package, the complexity of the device precludes a very small package.

It may therefore be appreciated that there exists a substantial need for an anti-siphon valve of a simple design enabling the inexpensive manufacture of the valve. The valve must be very small, long lasting and corrosion resistant, and must work regardless of what position the valve is oriented in due to different installation requirements. The valve must close whenever a pressure drop occurs in the supply line, not just when reverse fluid flow occurs.

In addition, it is desirable that the valve be adaptable to include a nozzle element for use in combination with a toilet seat as a jet for a bidet device. It may be appreciated that since the valve will be installed on the toilet seat, it must therefore be fairly small. Finally, it is desirable that the valve include an air vent and that the design of the valve insure consistent operation to eliminate the possibility of reverse fluid flow through the valve.

Summary of the Invention

The present invention is a valve manufactured of only three pieces—a housing, a cylindrical or piston-shaped valve element, and a plug to close the end of the housing. The housing includes therein a cylindrical valve chamber in which the cylindrical or piston-shaped valving element is reciprocally located, as well as an adjacent recessed chamber communicating with the main cylindrical valve chamber.

The valve features an air vent to initiate the valving operation of the device whenever pressure on the supply side of the valve drops below atmospheric pressure. In addition, the adjacent recessed chamber is located so as to cause the cylindrical valving element to move into a closed position should reverse fluid flow through the valve begin, thus preventing such reverse fluid flow through the valve.

The valve which, as stated above, consists of only three pieces, requires absolutely no machining of the surfaces thereof, and may in fact be manufactured of molded plastic for maximum economy of construction. Since the valve is manufactured of plastic, it is by nature long lasting and completely corrosion resistant.

Finally, due to the unique design of the present invention the valve will work regardless of the position the valve is manufactured in. The valve housing is so configured as to be able to accept a nozzle device to enable the valve to be used for bidet type applications. It may thereby be appreciated that the present invention provides a positive acting anti-siphon valve which, while simple and economical to manufacture, is still long lasting and corrosion resistant.

BRIEF DESCRIPTION OF THE DRAWINGS

A better understanding of the present invention may be had from a consideration of the following detailed description, taken in conjunction with the accompanying drawings in which.

DETAILED DESCRIPTION OF THE PREFERRED EMBODIMENT

Figure 1:
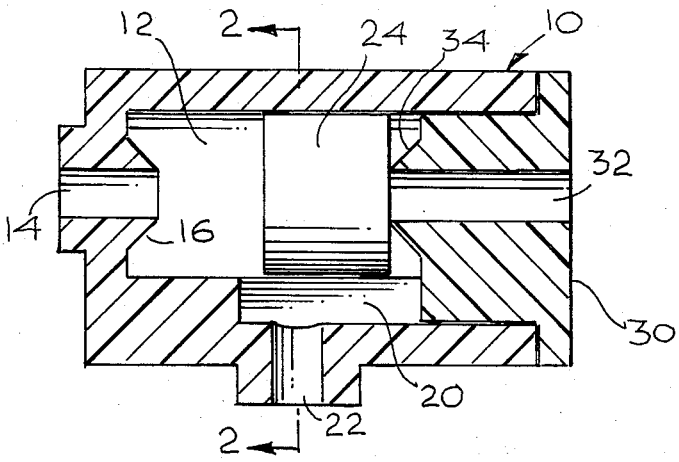
FIG. 1 is a cross-sectional view of the valve of the present invention illustrating the internal design thereof with the cylindrical valve piston being in the open position.

The valve assembly of the present invention is illustrated in FIG. 1 and consists of a valve housing 10 of unitary, preferably molded, construction, with a cylindrical valve chamber 12 located in the valve housing 10. The cylindrical valve chamber 12 is open on one end of the valve housing 10, and communicates with an inlet passage 14 on the other end of the valve housing 10. Constructed integrally with the valve housing 10 is a tapered valve seat 16 surrounding the inlet passage 14 and located in the cylindrical valve chamber 12.

Located adjacent to and adjoining the cylindrical valve chamber 12 in the valve housing 10 is a recessed chamber 20, which is of a smaller cross-sectional area than that of the cylindrical valve chamber 12. An outlet passage 22 communicates with the recessed chamber 20 to allow fluid to exit the valve housing 10.

Slidably located in the cylindrical valve chamber 12 is a cylindrical valve piston or cylindrical plug 24, which acts as the valve element for the device. Completing the valve is a vent casing plug 30, which is inserted into the open end of the cylindrical valve chamber 12 in the valve housing 10. The vent casing plug 30 defines an end for both the cylindrical valve chamber 12 and the recessed chamber 20. In addition, the vent casing plug includes an air vent 32 extending therethrough to the cylindrical valve chamber 12. Located on the vent casing plug 30 around the air vent 32 and facing the interior of the cylindrical valve. chamber 12 is a tapered vent seat 34.

It may be seen that the cylindrical valve piston 24 is restricted in location to the cylindrical valve chamber 12, in which it may slide back and forth between the tapered valve seat 16 around the inlet passage 14 and the tapered vent seat 34 around the air vent 32. In FIG. 1, the cylindrical valve piston 24 is shown in the open position adjacent to and in sealing contact with the tapered vent seat 34. It should be noted that the cavity within the valve housing defined by the cylindrical valve chamber 12 and the recessed chamber 20 will allow fluid on both sides of the cylindrical valve piston 24 when the cylindrical plug 24 is in the open position, the fluid being allowed to move on both sides of the cylindrical valve piston 24 through the recessed chamber 20. The cylindrical valve piston 24 closely fits the cylindrical valve chamber 12 to prevent fluid flow between the wall of the housing 10 forming the cylindrical valve chamber 12 and the cylindrical valve piston 24.

Figure 2:
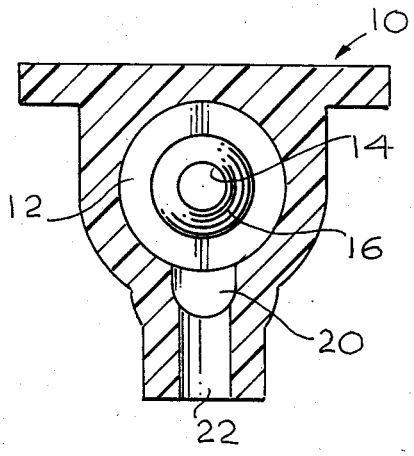
FIG. 2 is a cross-sectional end view of the housing of the valve shown in FIG. 1.
Figure 3:
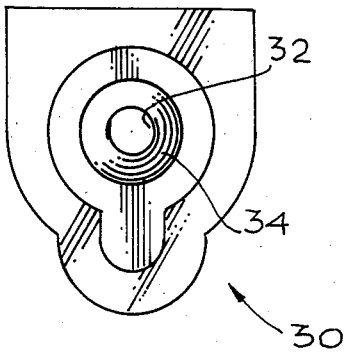
FIG. 3 is an end view of the vent casing plug of the valve shown in FIG. 1.

The valve housing 10, which is also shown in FIG. 2 to illustrate the cross-sectional configuration of the recessed chamber 20, is preferably manufactured of plastic. The vent casing plug 30 is shown in FIG. 3 to be so configured as to fit partially inside the cylindrical valve chamber 12 and the recessed chamber 20. The vent casing plug 30 may also be manufactured of plastic, and is installed onto the valve housing 10 using a plastic adhesive or plastic weld to form a permanent seal between the valve housing 10 and the vent casing plug 30.

The cylindrical valve piston 24 shown in FIG. 1 is preferably manufactured of rubber or resilient polymer to enable the formation of a good seal between the cylindrical valve piston 24 and either the tapered valve seat 16 or the tapered vent seat 34. The plastic and rubber construction of the valve of the present invention ensures that the valve will be long lasting and virtually corrosion resistant. Should fluids other than water be passed through the valve, other suitable materials may be utilized for the cylindrical valve piston 24, such as neoprene.

While the simplicity of construction of the present device may be appreciated from the fact that it requires only three parts, all of which may be molded without requiring machining, in order to properly appreciate the tremendous size advantage the present valve has over the relatively large prior art devices mentioned above, it is helpful to provide figures for comparison. The valve as shown in FIG. 1 may be constructed without requiring a high degree of precision in sizes less than one inch long and less than ½ inch in cross-sectional width. The resulting valve may therefore have application in locations where the installation of an anti-siphon valve was previously impossible.

Figure 4:
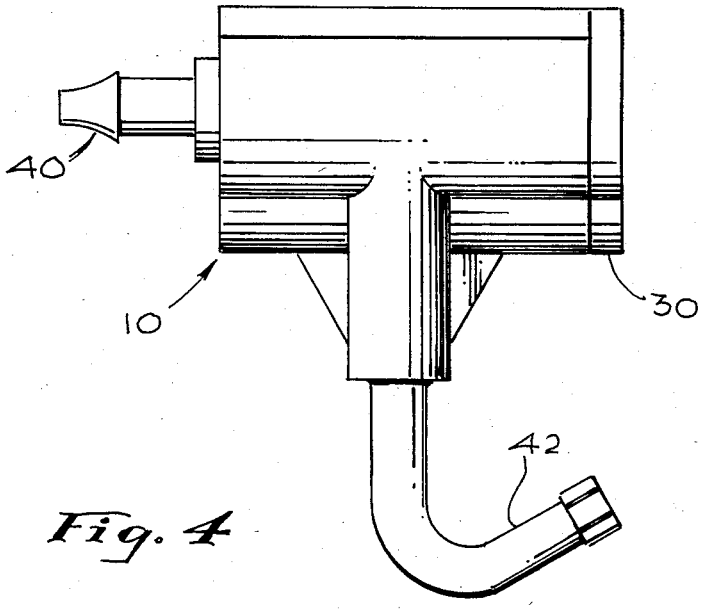
FIG. 4 is a plan view of a valve constructed according to the teachings of the present invention with a nozzle attached to the valve housing.

One such location is on the underside of a toilet seat, where the valve may be used to prevent backflow of water used for a bidet. As shown in FIG. 4, the valve housing 10 may be constructed with a nipple 40 communicating with the inlet passage 14 (FIG. 1) to allow the supply tubing (not shown) to be attached to provide a water supply to the valve housing 10. Similarly, an angled nozzle 42 may be frictionally inserted into the outlet passage 22 (FIG. 1) contained in the valve housing 10 to complete the nozzle assembly, which may then be mounted underneath the seat of a toilet for use as a bidet nozzle.

Figure 5:
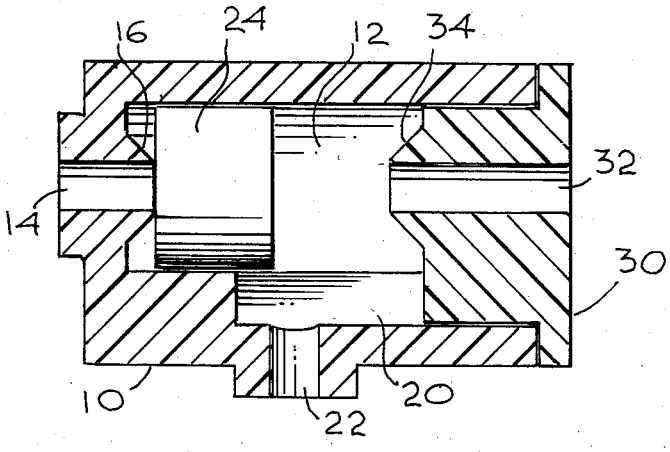
FIG. 5 is a cross-sectional view of the valve shown in FIG. 1 with the cylindrical valve piston in the closed position.

Referring once again to FIG. 1 and also to FIG. 5, the operation of the valve of the present invention will now be described. When a pressurized liquid is supplied to the inlet passage 14, the cylindrical valve piston 24 will move away from that inlet passage 14 and into contact with the tapered vent seat 34, thus sealing the air vent 32. Liquid will flow through the inlet passage 14 into the cylindrical valve chamber 12 and the recessed chamber 20, and out of the valve through the outlet passage 22.

Should the supply of liquid to the inlet passage 14 be interrupted, one of two possibilities will occur. First, should the pressure in the inlet passage 14 from the suply line drop to a value less than ambient air pressure, air will travel through the air vent 32 and cause the cylindrical valve piston 24 to move through the cylindrical valve chamber 12 against the tapered valve seat 16, closing the valve.

The second possibility is that the supply of liquid to the inlet passage 14 will stop, but pressure will remain at or about that of the ambient air. In this case, should liquid attempt to move into the valve through the outlet passage 22, it will be directed by the recessed chamber onto both sides of the cylindrical valve piston 24. A net force then develops on the end of the piston 24 adjacent the tapered vent seat 34, driving the cylindrical valve piston 24 toward the tapered valve seat 16 and closing the valve.

It may also be appreciated that operation of the valve mechanism of the present invention is completely independent of the physical orientation of the valve, thus representing a substantial advantage over the references described above. It may therefore be seen that the present invention represents a substantial improvement in the art in efficiency of operation, as well as presenting a simple, inexpensive technique for manufacturing a anti-siphon valve. In addition to these significant advantages, the present invention may be constructed in sizes substantially smaller than previously possible, thereby enabling the use of an anti-siphon valve in locations in which previous installation of anti-siphon valves has heretofore been impossible.

Although there have been described above specific arrangements of an anti-siphon nozzle in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. An anti-siphon valve comprising:

a housing having an end wall closing one end and being open at the other end;

said housing also having side walls defining a cylindrical bore extending to said end wall and further defining a recess extending radially outward from only one side of said cylindrical bore and alongside a portion only of the length of the cylindrical bore from said open end to a point displaced from said end wall;

an end plug configured to fit the cross section of said cylindrical bore and said recess and being mounted in the open end to close said open end and define respective cylindrical and recessed chambers open to each other along their common extent;

the end wall defining an inlet passage extending generally axially of said bore for admitting liquid into the cylindrical chamber;

the plug defining an air vent extending generally axially of said bore for admitting air into the cylindrical chamber;

said housing sidewalls defining an outlet passage for transmitting liquid from said recessed chamber as it is admitted into the cylindrical chamber via said inlet passage; and a free floating cylindrical piston mounted for axial movement along said cylindrical chamber between a first position closing the air vent and a second position closing the inlet passage, said piston being responsive to a drop in fluid pressure within said cylindrical chamber to move to said second position.

2. An anti-siphon valve as defined in claim 1 wherein said housing comprises a unitary piece of molded plastic.

3. An anti-siphon valve as defined in claim 1 further comprising a tapered valve seat surrounding said inlet passage and located on the interior of said housing in said cylindrical chamber at said one end of said cylindrical chamber.

4. An anti-siphon valve as defined in claim 3 wherein said valve is in said second position when said cylindrical piston is in contact with said tapered valve seat.

5. An anti-siphon valve as defined in claim 1 further including a nipple attached to said housing so that the interior of said nipple communicates with said inlet passage, said nipple comprising means for attaching a fluid supply line to said valve.

6. An anti-siphon valve as defined in claim 1 wherein said recessed chamber communicates with said cylindrical chamber on both ends of said cylindrical piston when said piston is in said first position.

7. An anti-siphon valve as defined in claim 6 wherein said cylindrical piston is driven from said first position to said second position whenever reverse fluid flow into said outlet passage occurs, thereby preventing reverse flow through said valve.

8. An anti-siphon valve as defined in claim 1 wherein said plug is manufactured of molded plastic and is sealably affixed to said housing.

9. An anti-siphon valve as defined in claim 1 further comprising a tapered vent seat surrounding said air vent and located on the portion of said plug facing the interior of said cylindrical chamber when said plug is installed onto said housing to close said other end of said cylindrical chamber.

10. An anti-siphon valve as defined in claim 9 wherein said valve is in said first position when said cylindrical piston is in contact with said tapered vent seat.

11. The valve of claim 9 whrein the tapered vent seat surrounding the air vent is configured to direct liquid flowing toward the cylindrical chamber from the recess chamber and outlet passage against the face of the cylindrical piston adjacent the plug with an axial vector tending to bias the piston toward said second position.

12. An anti-siphon valve as defined in claim 1 wherein said cylindrical piston is driven from said first position to said second position by ambient air pressure through said air vent whenever fluid pressure supplied to said inlet passage is less than ambient air pressure.

13. An anti-siphon valve as defined in claim 1 wherein said cylindrical piston is made from rubber and substantially prevents fluid flow between the walls of said housing forming said cylindrical chamber and the sides of said cylindrical piston.

14. An anti-siphon valve as defined in claim 1 further comprising a nozzle for installation into said outlet passage extending out of said housing.

15. The valve of claim 1 wherein the cylindrical piston in moving from the first position to the second position closes off communication between the recessed chamber and the inlet side of the cylindrical chamber prior to reaching said second position.

16. The valve of claim 1 wherein the piston is in the shape of a right circular cylinder with at least the opposite faces of the piston being formed of a resilient material.

* * * * *